US006402636B1

(12) United States Patent
Chang

(10) Patent No.: US 6,402,636 B1
(45) Date of Patent: Jun. 11, 2002

(54) GOLF CLUB FOR MINIMIZING SPIN OF GOLF BALL

(76) Inventor: Dale U. Chang, 2900 Sun Bittern Ct., Windermere, FL (US) 32786

( * ) Notice: Subject to any disclaimer, the term of this patent is extended or adjusted under 35 U.S.C. 154(b) by 0 days.

(21) Appl. No.: 09/404,048

(22) Filed: Sep. 23, 1999

Related U.S. Application Data

(63) Continuation-in-part of application No. 08/917,971, filed on Aug. 27, 1997.

(51) Int. Cl.[7] ..... A63B 53/04
(52) U.S. Cl. ..... 473/324; 473/349
(58) Field of Search ..... 473/324, 342, 473/349

(56) References Cited

U.S. PATENT DOCUMENTS

| | | | | |
|---|---|---|---|---|
| 4,159,286 | A | | 6/1979 | Khattab |
| 4,471,961 | A | * | 9/1984 | Masghati |
| 4,532,054 | A | | 7/1985 | Johnson |
| 4,812,187 | A | * | 3/1989 | Honma |
| 4,960,279 | A | * | 10/1990 | Harris |
| 5,011,151 | A | | 4/1991 | Antonious |
| 5,016,883 | A | * | 5/1991 | Kobayashi |
| 5,423,535 | A | * | 6/1995 | Shaw |
| 5,425,535 | A | | 6/1995 | Gee |
| 5,467,989 | A | | 11/1995 | Good et al. |
| 5,480,153 | A | | 1/1996 | Igarashi |
| 5,485,998 | A | * | 1/1996 | Kobayashi |
| 5,489,098 | A | | 2/1996 | Gojny et al. |
| 5,587,209 | A | | 12/1996 | Soga |
| 5,597,364 | A | | 1/1997 | Thompson |
| 5,620,382 | A | | 4/1997 | Cho |
| 5,643,110 | A | | 7/1997 | Igarahi |
| 5,702,827 | A | | 12/1997 | Itoh |
| 5,743,812 | A | * | 4/1998 | Card ..... 473/327 |
| 5,744,549 | A | | 4/1998 | Lutz |
| 5,779,560 | A | * | 7/1998 | Buck |
| 5,797,807 | A | * | 8/1998 | Moore ..... 473/345 |
| 5,851,158 | A | * | 12/1998 | Winrow |
| 5,885,171 | A | * | 3/1999 | Sharpe ..... 473/330 |
| 6,030,294 | A | * | 2/2000 | Shira |
| 6,059,670 | A | * | 5/2000 | Mogan |

FOREIGN PATENT DOCUMENTS

| | | | |
|---|---|---|---|
| JP | 52026929 | | 2/1977 |
| JP | 8-52243 | * | 2/1996 |

* cited by examiner

*Primary Examiner*—Stephen Blau
(74) *Attorney, Agent, or Firm*—Beusse Brownlee Bowdoin & Wolter PA; David G. Maire, Esq.

(57) ABSTRACT

A golf club, such as a driver, includes a head designed for reducing spin imparted to a golf ball struck by the club head. The club head has a face portion for contacting a golf ball that is formed of a relatively hard material having a generally slippery characteristic. The golf ball slips on the face portion when a plane of the face portion at a point of contact between the ball and face portion is not generally normal to a direction of travel of the club head. The slippery characteristic may be obtained by forming the face of the club head from a sintered material impregnated with a lubricant such as PTFE. The club head may also include a plastic insert with a self-lubricating filler.

9 Claims, 2 Drawing Sheets

GOLF CLUB FOR MINIMIZING SPIN OF GOLF BALL

This application is a continuation-in-part of 08/917,971 filed Aug. 27, 1997.

The present invention relates to golf clubs and, more particularly, to a golf club which minimizes the spin rate of a golf ball struck by the club.

BACKGROUND OF THE INVENTION

The majority of commercially available golf balls are advertised as having high spin rates since such spin rates are desirable for the better golfer. A high spin rate in a golf ball indicates that the ball rotates very rapidly about its axis when struck by the skilled player. The advantage of the high spin rate is that the ball can be made to produce a reverse or back spin so that the ball stops very quickly when hit into a green on an approach shot.

While high spin rates are desirable for the professional or better golfer, most amateur golfers are not capable of hitting a ball in a manner to produce controlled spin on the ball. More importantly, most amateur golfers have a swing which is either an inside- out or outside-in swing that produces side spin on the ball. Side spin causes the ball to move laterally off a desired target line, i.e., in either a hook or slice direction. For such amateur golfers, it is desirable to eliminate or at least substantially reduce spin of the ball so that the ball travels in essentially a straight line from the club face without the detrimental side spin. Further, eliminating most of the ball spin will cause the ball to travel a further distance in a desired direction.

Notwithstanding the marketing effort used to promote high spin golf balls, such spin is actually imparted to the ball by friction between the ball and club face when the ball is struck with the club such that the path of travel of the club face at the moment of impact is not normal to a plane of the club face at the impact point. In other words, the club face strikes the ball with a glancing or sliding blow. When the golfer is trying to impart a back spin to the ball, such as with a wedge, so as to stop the ball from rolling forward or to make the ball back-up, this spin characteristic or function is important. However, the average amateur golfer does not have the skill required to impart a controlled spin to a golf ball. Rather, the average amateur tends to strike the ball with an outside to inside swing which imparts a side spin to the ball causing the ball to curve away from the intended line of flight. Accordingly, for the average amateur golfer, it is desirable to minimize any spin imparted to a golf ball when struck by a golf club.

SUMMARY OF THE INVENTION

The present invention addresses the above stated and other disadvantages associated with striking a golf ball with a glancing or sliding blow from a golf club by providing a golf club which is specially adapted with a ball striking face portion which slips against the ball surface so as to minimize spin imparted to the ball. In an illustrative embodiment, the invention is shown in a conventional style golf driving club having an insert in its ball striking face wherein the insert is impregnated with a lubricating material so as to create a slippery surface. The lubricating material may be a dry lubricant, such as Teflon® (PTFE) or molybdenum disulfide, or a fluid lubricant such as a petroleum or synthetic product. Alternately, the insert could have a surface finish of a conventional, hardened PTFE material such as is used on cookware, for example, a Silverstone® finish. The insert may be formed of a thermoplastic material or a sintered metal. It is also contemplated that the club head could be a cast metal head of the type presently used for golf clubs and that the insert could be cast in situ as an entire face of the head or a portion thereof.

In one form, the insert or club face is formed with a substantially smooth, flat surface free of grooves and indentations. However, it may be desirable for some players to include horizontally oriented grooves to enable imparting of back spin to the ball to better control the distance that the ball travels. For other players, it is believed that smooth ball striking face will not only improve direction of ball flight but will also allow the ball to travel further in the air and roll further after hitting the ground. The travel and roll distance is believed to be improved by the reduced spin rate.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENTS

Figure 1:
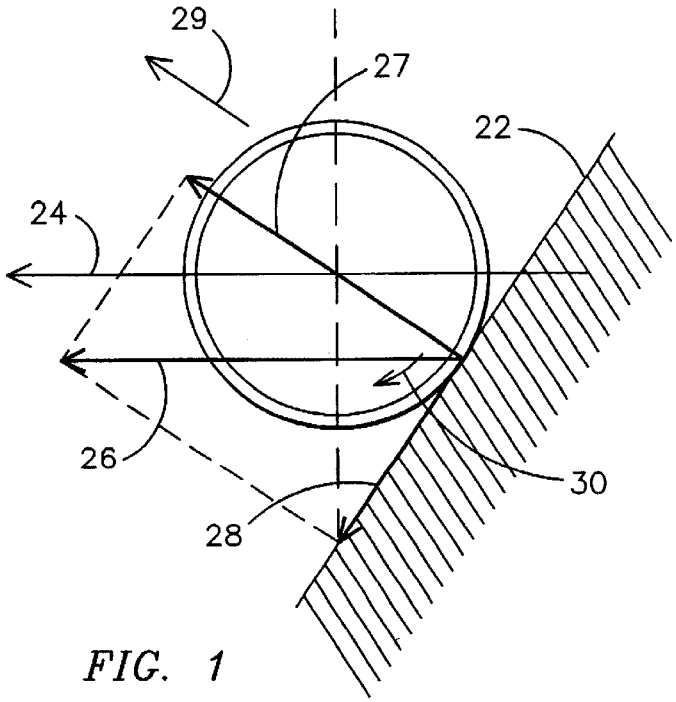
FIG. 1 illustrates the effect of an angled club face striking a golf ball.
Figure 2:
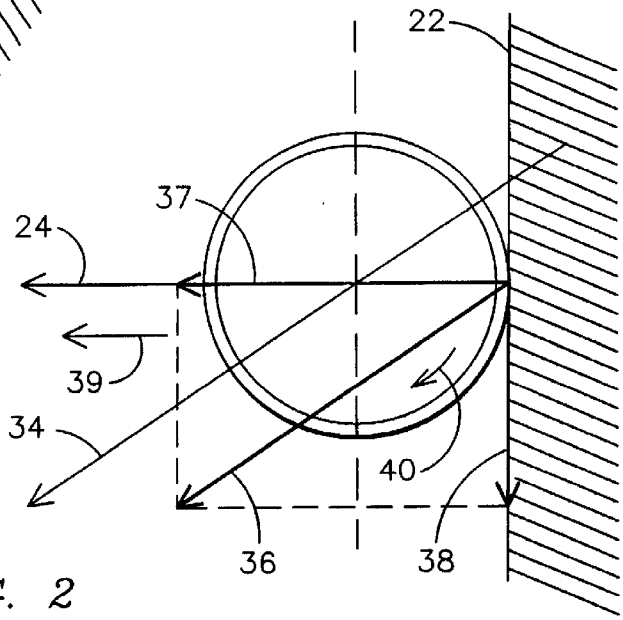
FIG. 2 illustrates the effect of a club face striking a ball when the face is square to a target line and the path of club travel is off line.

In order to understand the mechanism by which the present invention reduces the tendency of a golf ball to spin and thus impart side ways motion to the golf ball, reference is now made to FIGS. 1 and 2 which illustrate the various forces imposed on a golf ball 20 by a club face 22 striking the ball with either the club face in an open position with respect to a desired line of flight (target line) of the ball or with the club face square to the desired target line but with the direction of impact being at an angle to the desired target line. Turning first to FIG. 1, the club face 22 is shown in an open position with respect to the desired target line 24. As a result, the club face initially contacts the ball 20 at a point inside (with respect to the golfer's position) the target line 24 which extends through the center C of the ball causing the hitting force 26 to divide into normal force component 27 and tangential force component 28. The normal force 27 is used to carry the ball in the ball flight direction 29 while the tangential force 28 generates a moment about the center C of the ball causing the ball to rotate as indicated by the arrow 30. The tangential force 28 is reduced if the coefficient of friction between the club face 22 and the ball is low. This low tangential force will generate low moment thus causing less spin of the ball and less deviation from the target line.

The spin imparted to the golf ball, in this example, a counterclockwise spin, causes the ball to have a "slicing path" of travel, i.e., to move in a clockwise direction from the initial path indicated by normal force line 27.

A similar result occurs if the club face 22 is actually square to the target line 24 but approaches the target line at an angle such as that indicated at 34 of FIG. 2. In this example, the club face 22 initially contacts the ball 20 at a point on the target line 24 extending through the center of the ball but the direction of travel of the club creates a hitting force 36 which divides into normal force component 37 and tangential force component 38. The normal force 37 is used to carry the ball in the ball flight direction 39 while the tangential force 38 generates a moment about the center of the ball causing the ball to rotate as indicated by the arrow 40. As a result, the ball leaves the club face in the general direction 39 of the target line but then deviates into a slice or clockwise motion away from the target line. Similar action occurs but in an opposite or "hook" direction if the club direction of travel is inside out rather than outside in.

In both the actions illustrated in FIG. 1 and in FIG. 2, if the frictional force (tangential forces 28 and 38) between the club face and the ball can be reduced so that the ball is not imparted with a spinning motion by its impact with a club, then the ball will have more of a tendency to travel in a straight line as it leaves a club. Such reduction in frictional force can be achieved by making the club face 22 "slippery" so that the club face slips on the ball surface and the tangential force 28 or 38 is reduced to concurrently reduce the amount of spin imparted to the ball. Although the ball flight in FIG. 1 is not likely to be in the desired direction, i.e., along the target line, it will at least fly in a generally straight direction rather than veering substantially off of the initial ball flight path due to the spin on the ball. In the situation illustrated in FIG. 2, the ball will actually move along the target line even though the path of the club face is not along the target line. If the spin imparted to the ball by the club face can be completely eliminated, the ball flight path can be straight even though the club face is not moving in that target line direction.

Figure 3:
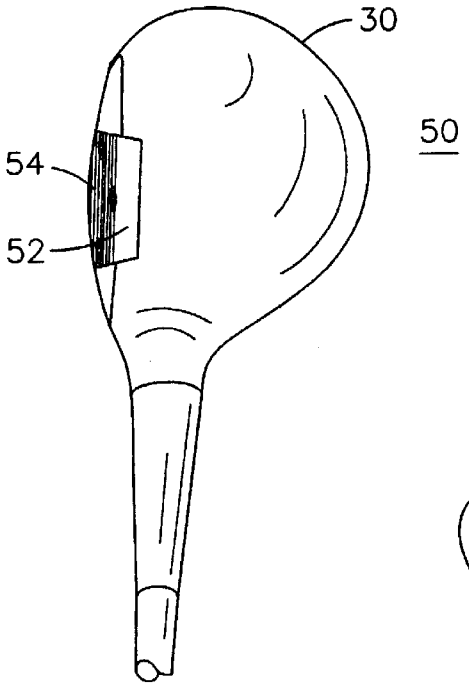
FIG. 3 is a top plan view of one form of golf club incorporating a slippery club face as taught by the present invention.
Figure 4:
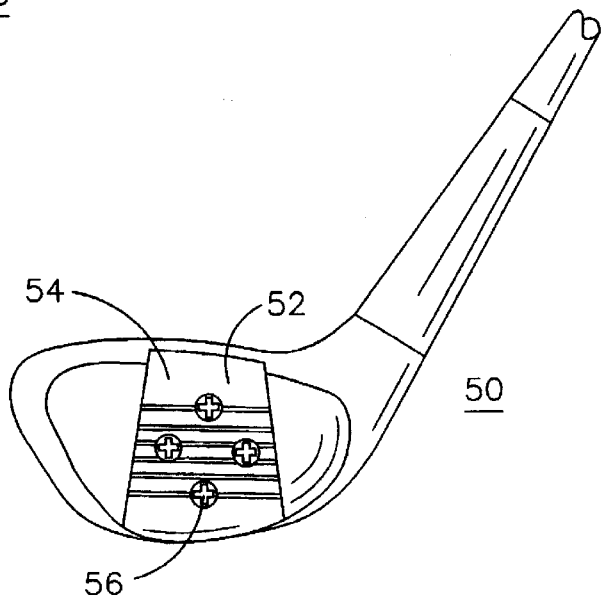
FIG. 4 is a face view of the club of FIG. 3.

The present invention is illustrated in one form in FIG. 3 in a conventional golf driving club 50, i.e., a "wood" or metal driver, having an insert 52 with a ball striking face 54. In a typical wood club, the insert 52 is held in place by screws 56 in addition to being adhesively bonded to the club. Similar inserts can be used with metal driving clubs but are generally bonded to the club using some form of epoxy resin. It is also believed that a metal driving club could be cast with the face portion formed of a different material if the face portion were placed in the casting mold prior to the material of the remainder of the club head. This latter method could be used to create an integral club head with a lubricant impregnated face portion, i.e., a face portion having the desired "slippery" characteristic when impacting a golf ball. It is also within the scope of the invention to form the entire club head of a lubricant impregnated material or to form the insert or club head so that only the outer ball striking surface incorporates a lubricating or slippery material.

While it is possible to achieve the goal of providing a "slippery" club face by putting some form of coating on the club face, such method is not preferred since rules of the United States Golf Association (U.S.G.A.) prohibit any foreign material on the club face. However, for use in non-sanctioned U.S.G.A. play, the club face of a conventional club could be covered by some of the fluoropolymer materials described herein, for example, a thin layer of hardened PTFE, and is believed to be capable of exhibiting the slipping characteristic according to the present invention. Examples of known fluoropolymers are Algoflon from Ausimont USA, Inc.; Chemfluor from Norton Performance; Fluon from ICA Americas, Inc.; Hostaflon from Hoeschst Celanese; and Teflon from E.I. DuPont; Fluoropolymers or fluoronated polymers are known generically, for example, as polytetrafluoroethylene (PTFE); fluorinated ethylene propylene (FEP); perfluoroalkoxyethylene (PFA); polychlorotrifluoroethylene (PCTFE); and ethylene-tetrafluoroethylene copolymer (ETFE).

Prior art U.S. Pat. No. 5,423,535 issued to Shaw, et al. on Jun. 13, 1995, teaches that it is desirable to provide a golf club having a ball-contacting face piece with a low friction characteristic. Materials identified by Shaw for the face piece include PTFE, which is generally considered a low friction material and has a coefficient of friction of approximately 0.05–0.15, and other materials that are generally considered not to have a low friction characteristic. These other materials suggested by Shaw include ceramic materials, glass and metal which have coefficients of friction in the range of 0.23–0.8. Shaw teaches a variety of shapes and materials for the face piece of a golfing "iron" club wherein the shape of the face piece is selected to control the weight distribution and the flexural modulus of the club head. The inventor of the present application has found that the device of Shaw is ineffective in reducing the spin of the golf ball even when the face piece is selected to be a low friction lubricating PTFE. Because the face piece of Shaw must be relatively thick in order to affect the weight distribution and flexural modulus of the club head, the low friction materials taught by Shaw, such as PTFE will indent heavily when subjected to the force of a golf ball impact. This force can be in the range of 1,000 to 2,000 pounds. The indentation of the face piece of Shaw results in a mechanical locking action between the face piece and the dimpled ball, thereby providing the high friction to impart significant spin to the ball in spite of a low coefficient of friction characteristic of the face piece material. In one experiment, the inventor attached a plate of PTFE of approximately 0.030 to 0.060 inch thickness to the ball-contacting surface of a driver club. The ball left a deep and clear ball dimple indentation pattern on the PTFE face that indicated that the ball was "locked" on the PTFE hitting face at impact. Due to heavy indentation of the PTFE, there was no sign of slipping of the ball on the PTFE surface, and the ball sliced or hooked badly when hit with a purposefully poor swing. Thus, the low friction materials taught by Shaw do not function as a low friction ball contact surface under high impact loads due to the softness of these materials. Furthermore, the softness of the lubricating material tends to reduce the distance of travel of the golf ball.

Figure 5:
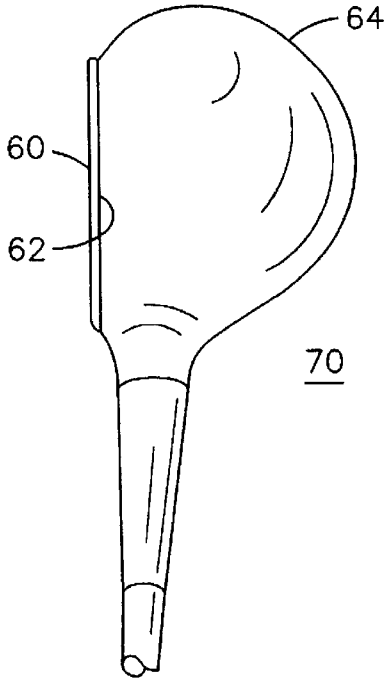
FIG. 5 is a top view of a golf club head incorporating a thin layer of lubricating material forming a ball contact surface.

The inventor has discovered that it is advantageous to utilize a coating layer of relatively soft, low friction lubricating material on the ball-contacting surface of a golf club provided that the coating is kept sufficiently thin, so that any indentation of the material during impact with a ball is minimized. Such a layer may be applied directly to a face portion of the body of the club head, or it may be applied to a hard insert that is attached to the club head. FIG. 5 illustrates a layer of lubricating material 60, such as for example PFTE or other dry lubricant, having a thickness of no more than 0.025 inch applied at the ball-contacting surface 62 of a metal driver golf club head 64. This thin layer of lubricating material 60 will reduce the amount of spin imparted to the ball by approximately one-half or less when compared to the same club without the layer of lubricating material. Because the layer of lubricating material 60 is thin and is backed by a hard surface of the club head, indentation of the lubricating material is limited and no significant mechanical locking action is developed between the golf ball and the club head. Furthermore, the distance of travel of the ball will be increased by the reduction of backspin. Lubricity of the ball-contacting surface without hardness does not accomplish this improved result. The thickness of the lubricating layer 60 in one embodiment is no more than 0.01 inch, and in an alternative embodiment is no more than 0.001 inch.

Fluoropolymers, such as PTFE material, is used, for example, as a hardened, non-stick coating on cookware, especially frying pans. In order to obtain the slick finished coating, it is desirable to polish the club face such that the surface roughness is less than about 25 micro inches RMS before applying the PTFE coating. The surface to be coated will be prepared specially for bonding of self-lubricating, non-stick coating such as DuPont finishes that include FEP, PTFE, ETFE, PFA, Teflon™, Teflon-S™, Teflon-P™, Tefzel™, Silverstone™, and Silverstone Supra™. The surface preparation includes cleaning and de-greasing, grit blasting, phosphate-pickling, conversion coating, etching, metalizing, plasma spraying, and electroplating. The coating can be applied by electrostatic (liquid or powder) or conventional spray, dip-spin, and fluidized bed processes. The applied coating will be cured by infrared or conventional gas and electric ovens (curing temperature is typically 200 to 800° F.).

Surface treatment for low friction, wear, and corrosion resistance is used in industrial applications for automotive components, cooking ware and medical devices. For aluminum and aluminum alloy golf heads, Endura™ "Infused Matrix" synergic coating is suitable. This process starts with surface cleaning, followed by surface conversion, fluoropolymer deposit, and fluoropolymer infusion. The surface cleaning includes de-greasing and chemical etching. The surface conversion is the process of converting the aluminum surface to a hard aluminum oxide (ceramic) of typically 0.001" surface growth and 0.001" surface penetration. The fluoropolymer deposit process is the process of depositing sub-micron sized fluoropolymers in and on the porous oxide surface. The last step of fluoropolymer infusion is the process of infusing the fluoropolymers into aluminum oxide substrate (curing temperature is typically 550 to 750° F.) to provide a permanent bonded surface. This process provides a hard, smooth, low friction, permanent dry film lubricated surface, with excellent abrasion and non-stick properties. The surface modification becomes an integral part of the base metal, and will not chip, crack, flake, or peel. The values of the coefficient of friction is typically between 0.14 and 0.24. The surface hardness ranges from 45 to 65 Rc which is the hardness of case-hardened and tempered steel.

Still another process which can be used for stainless steel, copper and aluminum golf club heads employs a nickel base. The ball striking face is cleaned first as in the previous process. Then an autocatalytic nickel matrix is deposited on the surface. The third step is the deposition of sub-micron sized fluoropolymers, and lastly the fluoropolymers are infused into substrate pores, then sintered to provide a bonded surface. The coating thickness ranges typically from 0.0003" to 0.003" and the values of the coefficient of friction range between 0.08 to 0.20. Typical hardness is 58 to 65 Rc which is equivalent of tempered steel.

For golf club heads which are made of ferrous and non-ferrous metals such as steel, stainless steel, aluminum, copper, titanium and their alloys, "fluoropolymer resin matrix" coatings can be applied. This process bonds high release, low friction polymers, both singularly and in plural composition that have been dispersed uniformly in a durable resin binder matrix to the base metal surface. The surface cleaning prior to coating is very important. The coating thickness is normally between 0.001" to 0.025". Coatings are applied by conventional spray, electrostatic (liquid and powder), and fluidized bed. Final sintering is accomplished at curing temperatures typically ranging from 250 to 800° F. The values of the coefficient of friction are typically 0.08 for dynamic and 0.15 for static friction. Hardness of the coating is typically 75 on the Shore D scale.

Another process that can be used for golf club heads which are made of ferrous and non-ferrous metals such as steel, stainless steel, aluminum, copper, titanium and their alloys, is "thermal spray polymer matrix" coating. This process consists of surface preparation and of depositing molten or semi-molten particles of stainless steel (or other alloys, and ceramics) under acceleration to form a hard and porous matrix on the base metal surface. This coating process is called plasma/thermal spraying. The matrix is sealed with the controlled infusion of high release, low friction fluoropolymers or lubricants. Typical coating thickness may range from 0.003" to 0.025". The coating becomes an integral part of the base metal. The hardness values depends on the powders used in the plasma/thermal spraying process. Typical values range from between 45 to 70 Rc.

Solid film lubricants can also be applied to the striking face of the golf club to reduce golf ball spin. Thin films of resin bind lubricating particles such as molybdenum disulfide, graphite, silicone or fluoropolymers to the surface of the golf club head. Superior lubrication is accomplished with molybdenum disulfide in combination with graphite.

The above-mentioned coating lubricating layers can be created by coating the club face with a dry lubricant or a combination of dry lubricants such as PTFE, FEP, PFA, ECTFE, PCTFE, ETFE, other fluoropolymers, molybdenum disulfide, graphite, and lead. The coating process starts with a surface preparation as discussed above. This surface preparation is necessary to mechanically hold the dry lubricant on the club face. For example, the metalizing or thermal spraying creates a porous metal particle layer on the club face for the dry lubricant to be fused into the pores of the layer. The same effect is achieved by sintering fine metal particles on the club face. This type of coating where the soft lubricating material is enclosed within the pores of a hard material is called an externally reinforced coating. In other cases, the club face is coated with an intermediary coating that will hold the dry lubricant coating. A matrix coating as described above utilizes one or more polymer binders, such as epoxy resin, PPS or polyamide, combined with a dry lubricant such as PTFE, FEP, PFA, ECTFE, PCTFE, ETFE, molybdenum disulfide, graphite and other fluoropolymers. One variation of the matrix coating is a stratified coating. A stratified coating is a matrix coating where the formulation keeps most of the low-friction agent on the surface of the coating. Finally, internally reinforced coatings use microfilaments or other reinforcement materials to provide a mechanical reinforcement of the lubricating coating layer. Often times these coatings may be fused at a curing temperature of 100 to 800 degrees F for adhesion and durability of the coating.

All of the above surface treating methods raise some question of acceptance under U.S.G.A. rules. However, at least some of these methods involve a molecular process which incorporates the slippery material into the club face. In those examples, it is believed that the materials are now an integral part of the club face rather than a prohibited coating.

In a preferred form, a golf driving club, whether wood or metal, is adapted for receiving an insert similar to insert 52 in which the insert is constructed with at least a face portion or layer which exhibits a slippery characteristic when a golf ball is struck on the face portion. The insert 52 may be formed of a sintered metal or sintered metal alloy including brass, steel and titanium alloys as well as others. The sintered metal can be impregnated with various types of lubricants using methods known in the industry. For example, Garlock Bearings, Inc. produces a self-lubricating bearing under their trademark DU which includes a porous bronze inner structure impregnated with a PTFE-lead lubricant to create a self-lubricating bearing material. For strength, the filled bronze may be mounted (bonded) to a steel backing plate. Garlock Bearings, Inc. also produces a steel-backed bearing material with a porous bronze inner structure and a modified acetal bearing surface with staggered pockets to retain initial lubrication. Accordingly, it is also known to impregnate lubricants in a thermoplastic base material. Another form of synthetic base material is made from glass fibers wound with a surface of PTFE.

Other forms of lubricating material could be used for insert 52 including molybdenum disulfide ($M_oS_2$) and graphite, both of which are classified as solid lubricants as is PTFE. In combination with a base material, whether a sintered metal or metal alloy or a thermoplastic, it is believed, by way of example, that the lubricant should be within the following ranges: for PTFE between about 15–20% by volume; for $M_oS_2$, between about 2–5% by volume; for graphite, about 20%; for silicone fluid, between about 2–5% by volume. The thickness of the layer in which the lubricant is impregnated may be as small as 0.001 inch and as large as the thickness of the insert.

As noted above, the amount of impregnated lubricant varies with the type of lubricant being used. The amount used should be sufficient to provide the "slippery" surface without compromising the strength of the insert. In the listed examples, it will be noted that silicone fluid is a possible lubricant and that silicone fluid is not a solid lubricant. Other lubricants of this type could be used, including petroleum based lubricants (oil and grease), providing that the lubricants are modified such that the surface of the insert is slippery without being "wet". Examples of synthetic lubricants which can be formulated in this manner are: polyglycols, phosphate esters, chlorofluorolubricants, polyphenyl esters, silicones, dibasic acid esters (or diesters), esters, polyethers, polyaromatics, silicate esters, and highly fluorinated compounds.

As a further example of a process for forming a slippery surface on a metal insert, it is known in the art to prepare a slippery metal surface by first roughing the surface and then spraying white-hot stainless steel particles on the roughened surface where they cool, harden and adhere to form a permanent part of the material having myriad peaks and valleys. This surface is then coated with one or more layers of a PTFE which is held in place by interface with the peaks and valleys. An example of such a product is distributed by the Whitford Corp. under their mark EXCALIBUR. Using this process on an underlying metal base, one can then machine suitably shaped inserts for golf clubs where the insert has a slippery outer ball contacting face.

While conventional golf clubs are generally designed to provide maximum friction between a golf ball and the club face, this invention is directed to providing a golf club which minimizes such friction to thereby reduce the spin rate of a ball struck by the club. Accordingly, it may also be desirable to construct the face of the golf club with a smooth surface, free of any grooves or indentations. However, it is contemplated that some horizontal grooves may be desirable to create a back spin on the ball. If horizontal grooves are used, they need to be so formed as to prevent any tendency of the grooves to interact with the ball in a manner to affect any side spin of the ball.

Figure 6:
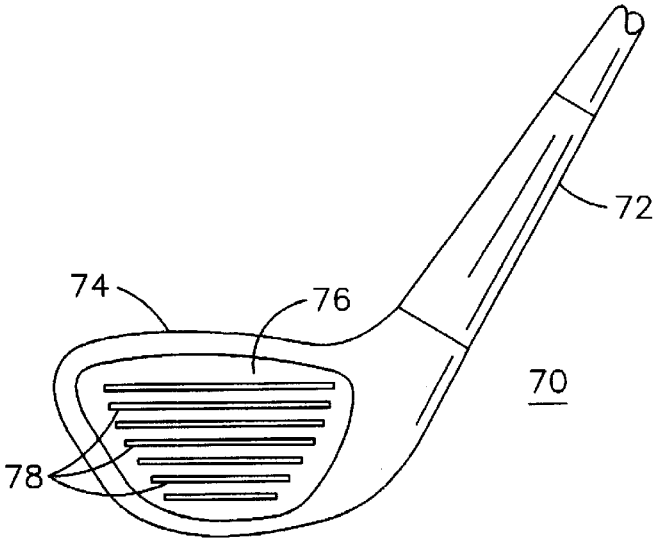
FIG. 6 is a front face view of a golf club having a smooth ball-contacting surface incorporating a pattern of lubricating material disposed in groove shaped recesses in the club face.

Because golf clubs traditionally have grooves on the club face, there may be some esthetic resistance to a club having a smooth face. It is possible to create a golf club having the appearance of a grooved club while actually having a smooth face, and having a hard and slippery ball-contacting surface in accordance with this invention. FIG. 6 illustrates a face view of a golf club 70 having a shaft 72 and a head 74 attached at one end of the shaft 72. A face portion 76 of the head 74 includes a plurality of fine grooves filled with a lubricating material 78. The surface of the lubricating material 78 is finished to be smooth and flush with the face portion 76 to form a smooth ball-contacting surface. The presence of the grooves filled with lubricating material 78 reduces the effective coefficient of friction of the ball-contacting surface during contact with a golf ball when compared to the coefficient of friction that would exist without the fine grooves of lubricating material. The material of the head 74 remaining between the grooves of lubricating material 78 provides support and protection for the lubricating material 78. The visual appearance of the club 70 is therefore maintained to be similar to a traditional club, yet in function the club 70 performs as a smooth faced club having a lubricated ball-contacting surface. In one embodiment, the grooves are 0.001 to 0.010 inch wide at the ball-contacting surface and 0.002 to 0.020 inch deep (thickness of lubricating material). The grooves may be formed with a keyway shape having the bottom of the groove wider than the top opening to retain the lubricating material in the groove. The lubricating material 78 may be PTFE, a combination of graphite and PTFE, or any other dry lubricant known in the art such as PTFE, FEP, PFA, ECTFE, PCTFE, ETFE and other fluoropolymers. The recesses in the face portion 76 may be formed in any pattern so that the ball-contacting surface of the face portion 76 has any desired appearance, such as the grooves illustrated in FIG. 6, a pattern of dots, or the pattern of a logo or trademark of an advertiser. The pattern is preferred to be composed of fine lines and/or dots. The total area of the lubricating lines and dots is desired to be a substantial portion, for example 10% or more, of the ball-contacting area to provide an effective lubricity. During use of the golf club, the lubricating material may be partially smeared out of the grooves, thereby providing a lubricating effect over an area that is actually greater than the area of the groove opening on the ball-contacting surface. The hardness or the strength of the club face material will be provided by the hard base material to prevent any mechanical locking of the club face and ball. If the desired pattern contains large areas of lubricating material, the depth of the recess, i.e. the thickness of the lubricating material, should be maintained to be less than 0.025 inch to avoid the creation of additional spin on the ball due to indentation of the lubricating material. A lubricating material may alternatively be infused into the ball-contacting surface of the club, as described above, in a pattern that takes a desired appearance on the club face.

If a ball is hit off-center, a spin will be imparted to the ball due to the center of gravity of the club not being directly behind the ball. This spin is known as the "gear" effect, and it results in the ball curving off-line in either the hook or the slice direction, depending upon whether the ball strikes closer to the heel or the toe of the club, respectively. In order to counteract the gear effect, it is known that conventional driver golf clubs may have a bulge in the club face 52. By bulge it is meant a curvature extending from heel to toe with the center of the club face extending slightly beyond the heel and toe portions in the direction of travel of the ball. The bulge will direct the initial line of flight of the ball to be in a direction opposed to the direction of the gear effect curve. The gear effect curve will then return the ball to the desired line of flight. Prior art driver clubs are known to have a radius of curvature for the bulge that is between 12–16 inches. Because a club designed in accordance with the present invention will impart less spin on the ball, the gear effect is reduced significantly. A golf club head built in accordance with the present invention may have a radius of curvature of the club face of greater than 18 inches. Alternative embodiments may have a radius of curvature of the club face of greater than 20 inches or greater than 30 inches.

It may be appreciated that a golf club having a ball-contacting surface that is both hard and slippery may be manufactured by a variety of known processes and may take a variety of different shapes. A hardness on the Rockwell C scale of greater than 20 is desired, with various embodiments having hardness greater than 25 or greater than 35 or greater than 45. A static coefficient of friction of no more than 0.3 is desired, with various embodiments having a static coefficient of friction of no more than 0.24 or 0.20, or 0.15 or 0.05. These properties may be obtained by infusing a lubricating material into a surface layer of the ball-contacting surface, by forming small recesses filled with lubricating material in the club head face to form a ball-contacting surface, or by installing on a club head an insert having such a ball-contacting surface. Alternatively, the lubricity of the surface may be achieved by applying a coating of lubricating material, provided however that the thickness of that coating should be no more than 0.025 inch, with various embodiments having a thickness of no more than 0.01 inch or 0.001 inch. The coating may be externally reinforced, internally reinforced or a matrix coating. By maintaining the layer of lubricating material to be thin, the effect of the softness of the material is minimal when compared to the benefit provided by the reduction of friction. The thickness of the lubricating coating may be thicker than 0.025 inch if the hardness and the structural integrity (strength) of the club face coating can be maintained either by internal or external reinforcement. For example, a sintered metal face of 3 mm or thicker may be infused or impregnated with a dry lubricant or a combination of dry lubricants throughout the entire thickness, even though the desired lubricity need only be applied to a very thin surface layer.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

Figure 7:
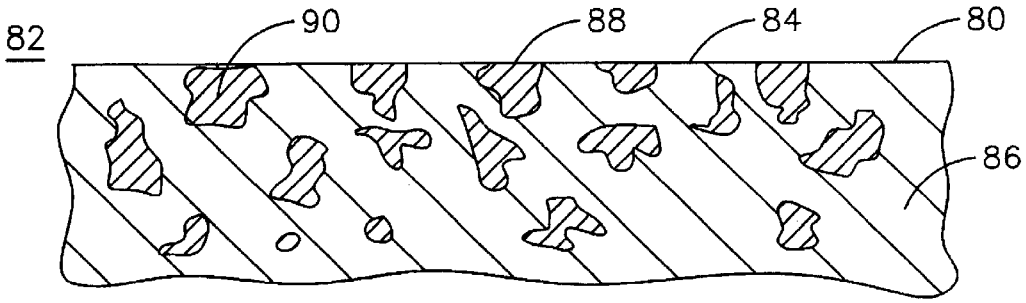
FIG. 7 is a partial cross-sectional view of a golf club ball-striking surface in accordance with an embodiment of this invention.

FIG. 7 illustrates a partial cross-sectional view of the ball-striking surface 80 of a golf club 82 in accordance with the present invention as described above. The ball-striking surface 80 includes the surface 84 of a matrix material 86, as well as the surface 88 of a dry lubricating material 90. The lubricating material 90 has been infused into the pores of the matrix material 86 and is flush with the matrix material 86 at the ball-striking surface 80.

What is claimed is:

1. A golf club with a ball contacting surface comprising a coating of a lubricating material, wherein the improvement comprises a matrix material harder than the lubricating material reinforcing the lubricant material to resist indentation of the lubricating material when subjected to a force of a golf ball impact, the matrix material being a metal, the matrix material having peaks and valleys with said lubricating material therein, said ball contacting surface being formed by said lubricating material and said matrix material, and said matrix material being disposed on a substrate.

2. The golf club of claim 1, wherein the lubricating material comprises a dry lubricant.

3. The golf club of claim 1, wherein the lubricating material comprises one of the group of PTFE, FEP, PFA, ECTFE, PCTFE, ETFE, molybdenum disulfide, graphite and lead.

4. The golf club of claim 1, wherein the lubricating material is formed to be flush with a top surface of the matrix material to form a smooth ball contacting surface.

5. The golf club of claim 1, wherein the ball contacting surface has a Rockwell C hardness value of at least 20.

6. The golf club of claim 1, wherein the ball contacting surface has a Rockwell C hardness value of at least 35.

7. The golf club of claim 1, wherein the ball contacting surface has a Rockwell C hardness value of at least 20, and a static coefficient of friction of no more than 0.3.

8. The golf club of claim 1, wherein the ball contacting surface has a Rockwell C hardness value of at least 20, and a static coefficient of friction of no more than 0.15.

9. The golf club of claim 1, wherein the ball contacting surface has a radius of curvature of greater than 18 inches.

* * * * *